US005505039A

United States Patent [19]

Maier

[11] Patent Number: 5,505,039

[45] Date of Patent: Apr. 9, 1996

[54] METHOD OF FILLING AND PRESSURIZING A CONTAINER

[75] Inventor: Hans E. Maier, Gelsenkirchen, Germany

[73] Assignee: Anton Hirsch, Giengen, Germany

[21] Appl. No.: 659,362

[22] PCT Filed: Jul. 19, 1990

[86] PCT No.: PCT/EP90/01182

§ 371 Date: Mar. 14, 1991

§ 102(e) Date: Mar. 14, 1991

[87] PCT Pub. No.: WO91/01252

PCT Pub. Date: Feb. 7, 1991

[30] Foreign Application Priority Data

Jul. 19, 1989 [DE] Germany ..... 39 23 903.9

[51] Int. Cl.[6] ..... B65B 3/00; B65B 31/00

[52] U.S. Cl. ..... 53/432; 53/470; 53/473

[58] Field of Search ..... 53/432, 470, 471, 53/473; 222/95, 389

[56] References Cited

U.S. PATENT DOCUMENTS

| | | | |
|---|---|---|---|
| 3,323,206 | 6/1967 | Clark | 53/470 X |
| 3,433,391 | 3/1969 | Krizka . | |
| 3,477,195 | 11/1969 | Chambers | 53/470 |
| 3,545,162 | 12/1970 | Clapp | 53/432 |
| 3,610,481 | 10/1971 | Marraffino . | |
| 4,150,522 | 4/1979 | Burger . | |
| 4,350,272 | 9/1982 | Petterson | 53/470 X |
| 4,387,833 | 6/1983 | Venus | 53/470 X |
| 5,137,179 | 8/1992 | Stoffel | 222/95 |

FOREIGN PATENT DOCUMENTS

| | | |
|---|---|---|
| 0148662 | 7/1985 | European Pat. Off. . |
| 2351009 | 12/1977 | France . |

*Primary Examiner*—Linda Johnson
*Attorney, Agent, or Firm*—Herbert Dubno

[57] ABSTRACT

A pressurizable package for a substance to be dispensed is formed by inserting a flexible liner into a pressurizable container and holding the closure of the container away from the mouth so that the space between the liner and the container can be pressurized with a gas. The closure is then sealed to the container to seal the space and maintain the pressure of gas around the liner which is evacuated to further collapse the liner, by applying a suction to a valve on the closure communicating with the interior of the liner. The liner is then filled through the valve with the substance to further pressurize the gas in the surrounding space.

3 Claims, 4 Drawing Sheets

METHOD OF FILLING AND PRESSURIZING A CONTAINER

CROSS REFERENCE TO RELATED APPLICATIONS

This application is a national phase of PCT/EP90/01182 filed 19 Jul. 1990 and based, in turn, on German national application P 39 23 903.9 filed 19 Jul. 1989 under the International Convention.

FIELD OF THE INVENTION

The present invention relates to a method of filling aerosol containers which consist of a vessel, which contains a propellant, and at least one flexible liner in it which serves for the acceptance of a product, the interior of the flexible liner being closed by a valve, which is positioned in the area of the opening of the vessel. The invention relates to the pressurized container as well.

BACKGROUND OF THE INVENTION

Pressurized containers are well known in which the product and the propellant are intermixed, dissolved, or dispersed, such containers being often or usually referred to as aerosol containers. After actuating the valve, the product and the propellant exit together.

It is also generally known that pressurized containers can be constructed as two-compartment spraying systems in order to avoid having the product come into contact with the vessel and/or the propellant. In this way it is possible to fill aggressive and pasty products into metallic vessels such as tinplate containers, and release the product as a spray, foam, or squeezed paste without intermixing with the propellant.

In two-compartment spray systems metal or glass vessels are used as outer containers, as they have been used for several decades as aerosol containers for filling with materials such as body care products, hair care products, insecticides, impregnating sprays, technical aerosols, etc. The liners which serve for the acceptance of the products which have to be released, are bags made of flexible material like, for example, thermoplastic synthetic material or aluminum. The bag, which is affected by the pressure of the propellant, is gradually compressed when the pressure in the liner is released and when the product is transported out of the opening of the valve of the pressurized container in the form of a spray, a foam, or a squeezed paste after the valve has been actuated.

As a propellant all types of compressed gases such as, preferably, environmentally safe compressed air, and also condensable gases can be used.

All these generally known two-compartment spray systems have in common a disadvantage that, on the bottom of the pressure resistant vessel, an additional small opening is required. The flexible liner is suspended in the container by being pinched at the brim of the opening of the vessel during the crimping process. In order to obtain clearance for the wall thickness of the liner in the area of its opening, the opening of the aerosol containers must be enlarged to be wider than the standard opening diameter.

The filling process is done in such a way that, firstly, the product is filled into the empty liner which previously had been inserted into the vessel; then the filled liner equipped with a valve is connected to the vessel by clinching. With special equipment the propellant is inserted by way of the small hole at the bottom. Then, the bottom hole is closed by means of an elastic bung. Now the necessary spray actuator or paste squeezing spout is mounted upon the valve which is combined with the vessel. By actuating the valve the product streams out of the vessel under the power of the pressurizing medium upon the liner.

Since the propellants which until recently were commonly used in aerosol containers, namely fluorochlorohydrocarbons, were thought to be harmful to the ozone layer of the globe, there has been an increasing interest to replace these propellants by less dangerous condensible gases or abandon all types of such propellants. The two-compartment spray systems, in which compressed air is the pressurizing agent and, in consequence, a propellant, are considered to be a good alternative. However, this system involves several disadvantages. The elastic bung which is inserted in the bottom hole tends to cause the loss of pressure during extended periods of storage because of the inadequate sealing resulting from the irregular shape of the hole and/or the deterioration of the bung material, as a result of which the function of the vessel is partially or completely impaired. The enlarging of the opening of the vessel and the creation of the bottom hole can be imprecise, so that the irregular deformation during the process of enlarging the diameter of the opening, and the perforation of the bottom cannot be avoided. In addition, containers which are modified in this way do not comply with the original design which has been approved by the authorities. Furthermore, the process of filling these containers is time consuming, complicated, and expensive.

OBJECT OF THE INVENTION

It is an object of the present invention to provide a process which avoids the disadvantages stated above and improves the nature of pressurized containers to such an extent that not only various types of propellants, especially pressurized air, can be used but also that the normal standard of aerosol containers can be employed, and the whole process of filling can be accomplished in a comparatively short time and thus with little expense.

SUMMARY OF THE INVENTION

According to the invention the flexible liner is inserted in the vessel so that between its brim of the opening and the opening of the vessel there will be a space, through the space between the brim of the opening of the liner and the opening of the vessel the propellant is introduced, the brim of the opening of the liner is then securely combined together with the opening of the vessel together with the valve, for evacuation of the inner volume the valve will be actuated, and after another actuation of the valve the product will be filled into the liner under pressure.

In order to be certain that a complete emptying of the interior of the liner is effected, and so that the latter is completely free of air, it has proven to be advantageous to accomplish this by evacuation.

Furthermore, the invention involves a pressurized container which consists of a vessel, which contains a pressurizing agent and at least one flexible liner in it which serves for the acceptance of the product, while the interior of the flexible liner is closed by a valve, which is positioned in the area of the opening of the vessel.

The flexible liner is a folded bellows shaped in such a form that its folds are folded inwardly, so that a comparatively large volume is available for the acceptance of the propellant.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
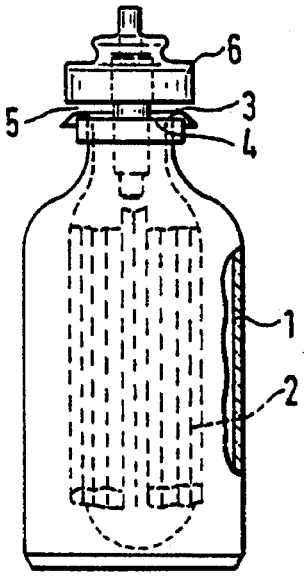
FIG. 1–FIG. 5 shows in elevational views (partly broken away in FIG. 1) the filling process of an aerosol glass bottle in its individual successive steps.
Figure 2:
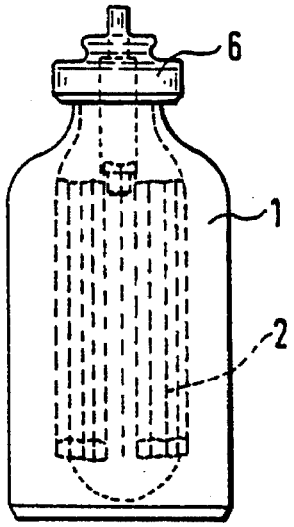
Figure 3:
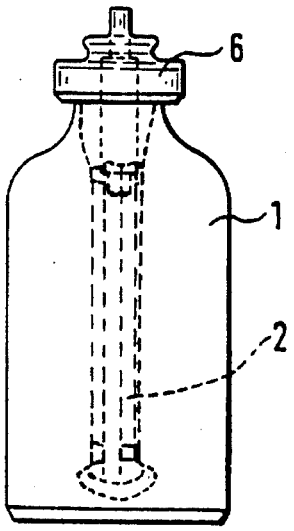
Figure 4:
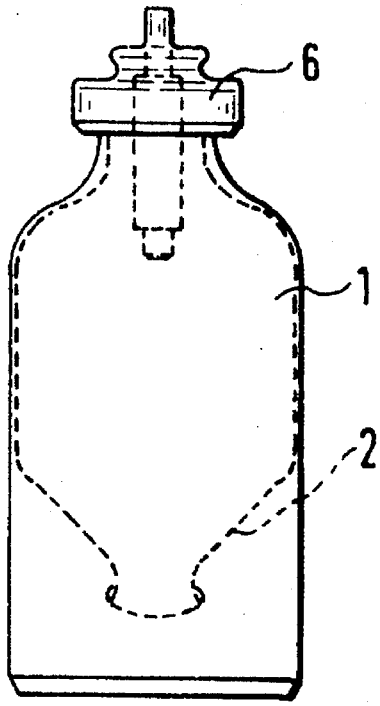

In the embodiment shown in FIG. 1–FIG. 5 a glass bottle is used as a vessel 1 which is surrounded by a sheathed plastic coating to protect against flying glass fragments. Inserted in the vessel 1 is the liner 2 in the shape of a folded bellows. The liner 2 is made of a thermoplastic material such as polyethylene. The liner 2 is inserted in the vessel 1 so that there is space 5 left between the brim of its opening 3 and the opening 4 of the vessel 1. For this reason the liner 2 is positioned above the opening 4 of the vessel 1 while the valve 6, in this case a bottle valve, is in a slightly elevated position. Through the space 5 left between the brim of the opening 3 of the liner 2 and the opening 4 of the vessel 1 the pressurizing agent is now filled by the head of a U-t-C gassing device which briefly is positioned upon the opening 4 of the vessel 1. During the momentary positioning of the head, the propellant enters the space between the inner wall of the vessel 1 and the outer wall of the liner 2. As soon as the desired pressure is reached in the vessel 1 the valve 6 is then crimped to the opening 4 of the vessel 1 while the brim of the opening 3 of the liner 2 is squeezed between the opening 4 of the vessel 1 and the valve 6. This step of the operation is shown in FIG. 2. By actuating the valve 6 (FIG. 3) and preferably by applying a vacuum the liner 2 will be completely evacuated, so that the liner will be compressed into a remarkably small volume and the pressure between the liner 2 and the vessel 1 will be reduced. Therefore, in the liner 2 there is no remaining air.

The pressurized container which is prepared according to the above mentioned steps can be either stored and marketed or filled immediately after being assembled. By inserting the filling goods (FIG. 4) under pressure, the liner 2 expands under the external pressure during the insertion of the filling goods, while the pressure of the propellant contained in the vessel is increasing. During the filling process the liner is expanded by the inserted goods, without the inclusion of air bubbles, so that any splattering or breaks in the discharge of the goods as a spray or an extrusate cannot occur.

Of essential importance is the consideration of the volume of the filling goods and the capacity of the expanded liner. The unexpanded liner is too small to accommodate the intended volume of the filling goods, so that the total amount of the filling goods needs to be inserted by force against the mechanical pressure of the propellant and against the resistance of the flexible material of the liner in its expansion. Thanks to its flexibility, the surface of the liner is much greater than when folded. Therefore, the intended pressure of the propellant in the space between the vessel and the liner is increased in a controllable manner. Through the process of forceful elongation of the flexible material of the liner, preferably thermoplastic material, the physical properties of its molecular structure are changed in a positive way, especially concerning the permeability. Although liners, without being expanded, have shown diffusion, surprisingly, has been learned after expansion that no more diffusion occurred. By the expansion of the liner during the process of filling with goods, the liner comes in contact with the bottom and/or the walls of the vessel, as a result of which the liner is firmly positioned inside of the vessel. In all existing two-chamber spray systems it is an apparent disadvantage that the liner is able to swing inside of the vessel and it is often noticed that by swinging inside of the vessel, a thinning of the wall thickness in the upper position of the liner can occur which can result in the failure of the liner during transport conditions, a problem which is involved with the design of the invention.

Figure 5:
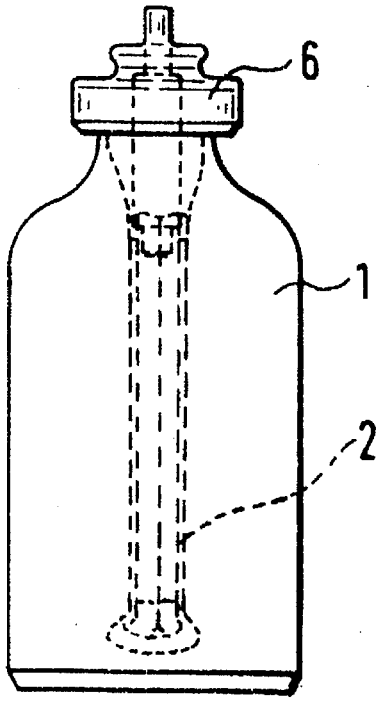
Figure 6:
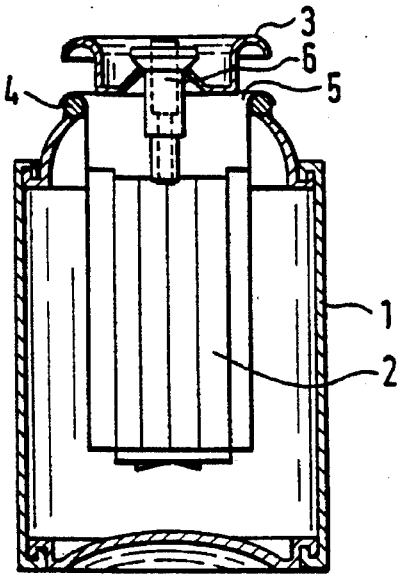
FIG. 6–FIG. 10 are elevational views (in section in FIG. 6) which show the filling process of an aerosol metal container in its successive steps.

During the process of discharging the liner 2 of the pressurized container by actuating the valve, the liner 2 is compressed by its tendency to regain its original form on the one hand and on the other hand by the pneumatic pressure in the vessel 1 (FIG. 5).

In the embodiment of FIG. 6–FIG. 10 the vessel 1 is an aerosol tinplate can with an inserted liner 2 and mounted valve 3 in the form of a 1" valve.

The single steps of the operation of filling with the pressurizing agent and with filling goods are the same as described above in combination with the embodiment of FIG. 1–FIG. 5.

Figure 7:
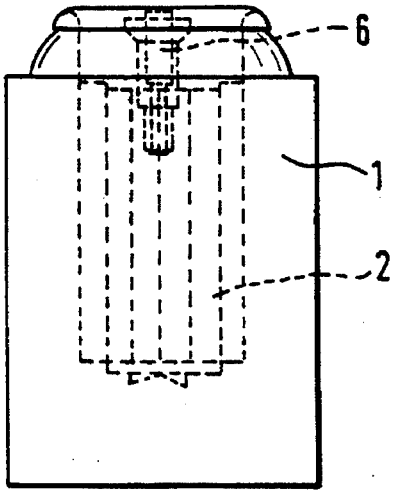
Figure 8:
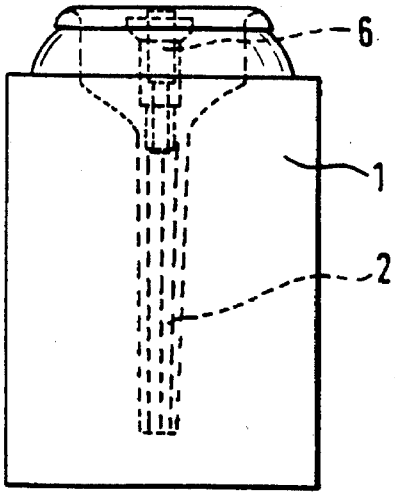
Figure 9:
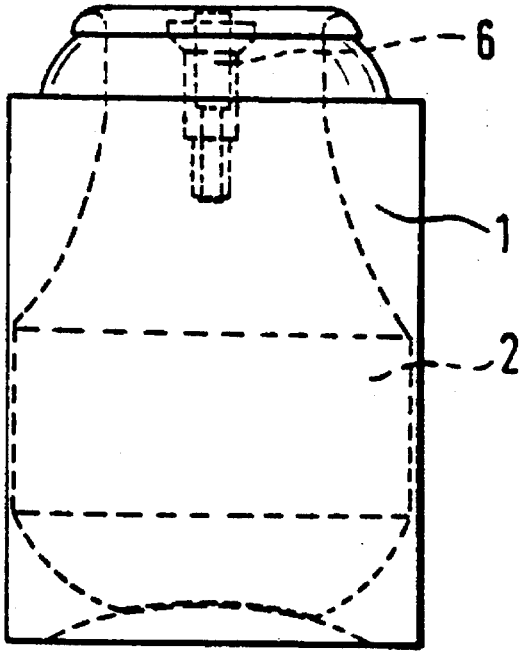
Figure 10:
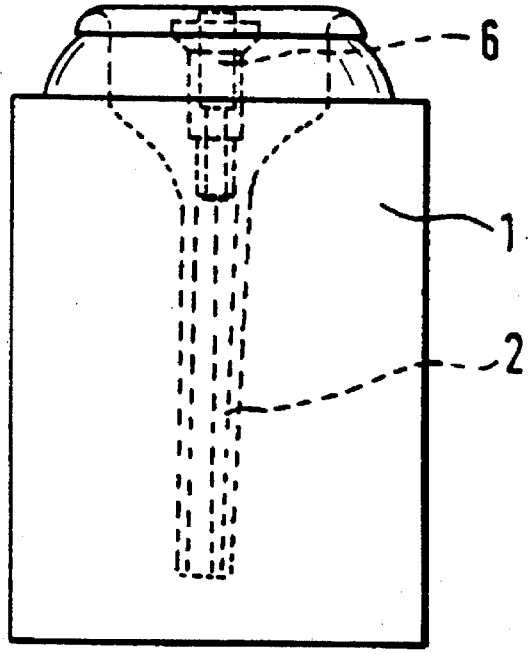

After reaching the desired pressure in the interior of the vessel 1 the liner 2 together with the mounting cup of the valve 6 is pressed into the vessel 1 and the closure is accomplished by crimping. The brim of the opening 3 of the liner 2, in this case, is positioned between the mounting cup of the valve 6 and the opening 4 of the vessel 1 (FIG. 7). After opening the valve 6 and adjusting the vacuum, the liner 2 is completely evacuated (FIG. 8). By filling the goods under pressure, the liner 2 expands (FIG. 9) and after having been discharged of its contents regains its contracted form (FIG. 10).

Because of the method according to the invention it is possible in contrast to the other generally known two-compartment spraying systems:

a. to use aerosol containers like those commonly on the market without any changes to the opening and/or on the bottom;

b. to accomplish the gas pressurization of the space between the inner wall of the vessel and the outer wall of the liner in a very simple way independent of the physical properties of the various filling goods with all types of pressurizing agents in a separate, independent step, so that the pre-pressurized empty vessels may be stored, marketed, or filled later with goods;

c. to forcefully elongate the evacuated compressed liner and thereby improve its physical properties, especially the resistance to diffusion;

d. to accelerate the speed of the filling operation to a considerable extent;

e. to increase the pressure within the empty, pre-pressurized vessel by forcefully filling it with filling goods; and f. to accomplish a refilling of the exhausted containers, in special cases, with like kind of filling goods.

By regulations, pressurized cans are non-reusable containers and they are not intended to be refilled commercially. In the case that the containers are not subject to the regulations, then by means of the described invention, it is possible to refill these containers with a like kind of filling goods after complete dispensing of the product.

I claim:

1. A method of filling and pressurizing a dispensing package, comprising the steps of:

(a) inserting an empty flexible liner having an interior and a liner brim into a pressurizable container through a mouth thereof so as to define a space around said liner in said container;

(b) holding said liner brim away from said mouth to define a gap between said brim and said mouth communicating with said space;

(c) pressurizing said space through said gap with a pressurizing gas while said brim is held away from said mouth;

(d) thereafter closing said gap by sealing said mouth against said brim thereby trapping gas pressure in said space, said brim being sealed against a valve closing said interior;

(e) thereafter through said valve upon opening thereof, evacuating said interior of said liner by applying a suction to said valve;

(f) following evacuation of said interior, through said valve upon opening thereof, forcing a substance to be dispensed from said container into the interior of said liner to expand said liner and further pressurize the gas in said space; and (g) then closing said valve to retain said substance in said container under a dispensing pressure, whereby subsequent opening of said valve enables discharge of said substance through said valve.

2. The method defined in claim 1 wherein said liner has initially the configuration of a folded bellows with internally pleated folds, said folds spreading outwardly upon filling of said liner with said substance.

3. The method defined in claim 1 wherein said liner is stretched during introduction of said substance into said liner to reduce fluid permeability of said liner.

* * * * *